US006634625B1

(12) United States Patent
Sudrot

(10) Patent No.: US 6,634,625 B1
(45) Date of Patent: Oct. 21, 2003

(54) MIXER FOR FLUID OR SOLID SUBSTANCES

(75) Inventor: Gilbert Sudrot, Aizier (FR)

(73) Assignee: Modutech SA, Villars-sur-Glane (CH)

( * ) Notice: Subject to any disclaimer, the term of this patent is extended or adjusted under 35 U.S.C. 154(b) by 0 days.

(21) Appl. No.: 09/958,750

(22) PCT Filed: Apr. 11, 2000

(86) PCT No.: PCT/CH00/00209

§ 371 (c)(1),
(2), (4) Date: Jan. 2, 2002

(87) PCT Pub. No.: WO00/61272

PCT Pub. Date: Oct. 19, 2000

(30) Foreign Application Priority Data

Apr. 14, 1999 (CH) ..... 0686/99

(51) Int. Cl.[7] ..... B01F 3/04
(52) U.S. Cl. ..... 261/87; 261/64.1; 366/106
(58) Field of Search ..... 261/87, 64.1, 93; 366/102, 103, 106

(56) References Cited

U.S. PATENT DOCUMENTS

| | | | | | |
|---|---|---|---|---|---|
| 1,806,068 | A | * | 5/1931 | Lepersonne et al. | 366/106 |
| 2,826,401 | A | * | 3/1958 | Peters | 261/87 |
| 3,584,840 | A | * | 6/1971 | Fuchs | 261/87 |
| 3,779,531 | A | * | 12/1973 | White | 261/87 |
| 3,911,064 | A | | 10/1975 | McWhirter et al. | |
| 4,249,828 | A | * | 2/1981 | Condolios | 366/102 |
| 4,595,296 | A | * | 6/1986 | Parks | 366/106 |
| 5,458,816 | A | * | 10/1995 | Ebner et al. | 261/64.1 |
| 6,193,221 | B1 | * | 2/2001 | Sherman | 201/87 |

FOREIGN PATENT DOCUMENTS

| | | |
|---|---|---|
| DE | 428 237 | 4/1926 |
| DE | 1 027 966 | 4/1958 |
| DE | 69 507 | 10/1969 |
| FR | 888 432 | 12/1943 |
| FR | 1 093 699 | 5/1955 |
| GB | 924 128 | 4/1963 |

* cited by examiner

*Primary Examiner*—C. Scott Bushey
(74) *Attorney, Agent, or Firm*—Nixon & Vanderhye PC

(57) ABSTRACT

The invention relates to a device that sets liquid or solid substances in motion and to a method for the implementation of said device. The invention more specifically relates to a device that sets liquid or solid substances in motion by means of gas bubbles, comprising a receptacle for said substances, at least one moveable gas emitting nozzle arranged in the lower part of said receptacle, and a system for conveying the gas to said nozzle.

5 Claims, 4 Drawing Sheets

FIG. 3
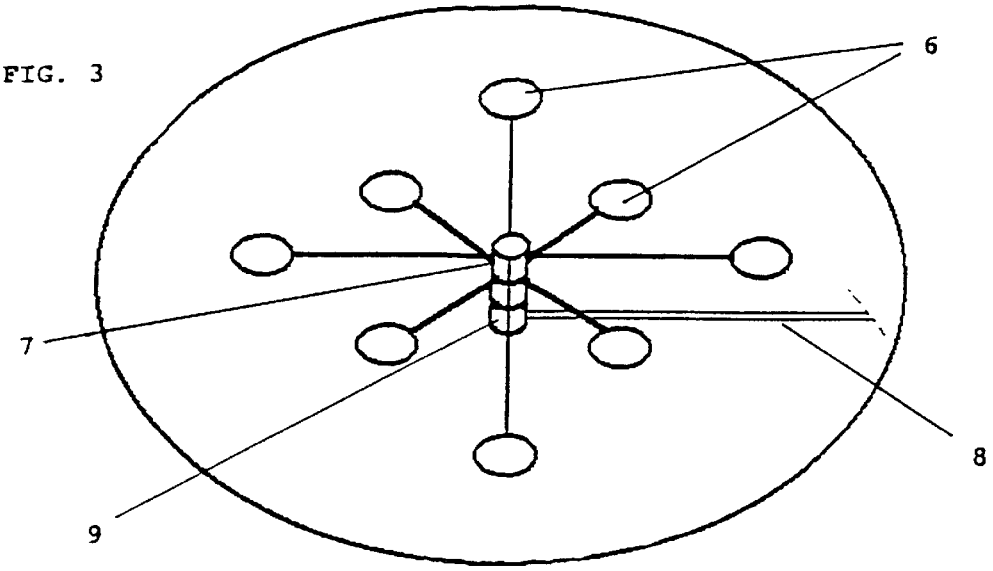
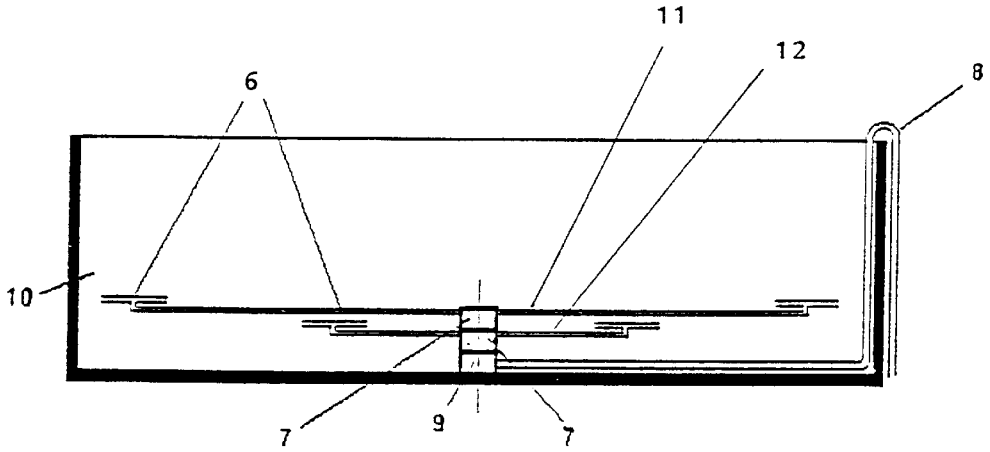
FIG. 4

MIXER FOR FLUID OR SOLID SUBSTANCES

This application is the U.S. national phase of international application PCT/CH00/00209 filed Apr. 11, 2000, which designated the U.S.

The present invention relates to a device for moving fluid or solid substances and to a method of using such a device.

More precisely, it relates to a mixer for fluid or solid substances by gas injection.

Such devices are disclosed in the state of the art. Documents EP-A-243 764 and WO 92/21434 disclose compartmented containers, the compartment containing the substance to be mixed being in contact, via a porous wall, with another compartment in which gas is generated or injected.

Documents GB 1 400 723, FR-A-2 482 471, U.S. Pat. No. 3,671,018 and U.S. Pat. No. 4,136,970 disclose mixers for fluid or solid substances comprising a container and at least a gas bubble nozzle which is situated in the lower part of said container. Mixing is carried out with the bubbles formation and elevation.

Document WO 85/03458 shows a mixer, similar to the previous ones, comprising several gas nozzles which are situated at the bottom of the container, each nozzle being made of an horizontal circular plate which is fixed to the bottom of the container by spacers, the gas being brought in a conduit bound to the nozzle upper part and ends in the space situated between the circular plate and the bottom of the container in such a way that the bubbles are generated in said space.

Documents DE-B-1027966, DE-C-428237, FR-A-888432, DD-A-69507, U.S. Pat. No. 3,911,064, FR-A-1093699 and GB-A-924128 disclose mixers comprising movable gas emitting nozzles.

The present invention relates to a device for moving fluid or solid substances, using of gas bubbles, comprising:

- a container adapted to contain said substances,
- at least one movable gas nozzle situated in the lower part of said container, the nozzle being fixed to a rotating vertical axis via a rod,
- nozzle driving means,
- a first gas routing system for the formation of bubbles at the nozzle, said device being characterized in that it furthermore comprises:
  - a second gas routing system for moving said nozzle, said second system being brought into relation with and partially being made of said nozzle driving means,
  - momentary gas routing interrupting means adapted to allow gas routing either into the said first system or into the said second system.

Any type of movement of the nozzles can be used, the nozzles may all move in a same horizontal plane or in different overlapping horizontal planes.

The nozzle shape is not limited to a specific design, provided it is adapted to emit gas bubbles and to move.

According to another embodiment, the nozzles are essentially made of two plates between which gas bubbles are generated.

The present invention also relates to a method of using the previous defined device.

The present invention can be used for several purposes. As an example we can cite the mixing: of oil in the earth oil industry, of polymers in the chemical industry and of cereals in the agro business.

More detailed ways to carry out the invention are discussed hereafter with the help of the following figures FIG. 1 shows the lower part of one embodiment of the device according to the invention.

FIG. 3 shows the lower part of another embodiment of the device according to the invention.

FIG. 4 shows a front view of the device of FIG. 3.

Figure 1:
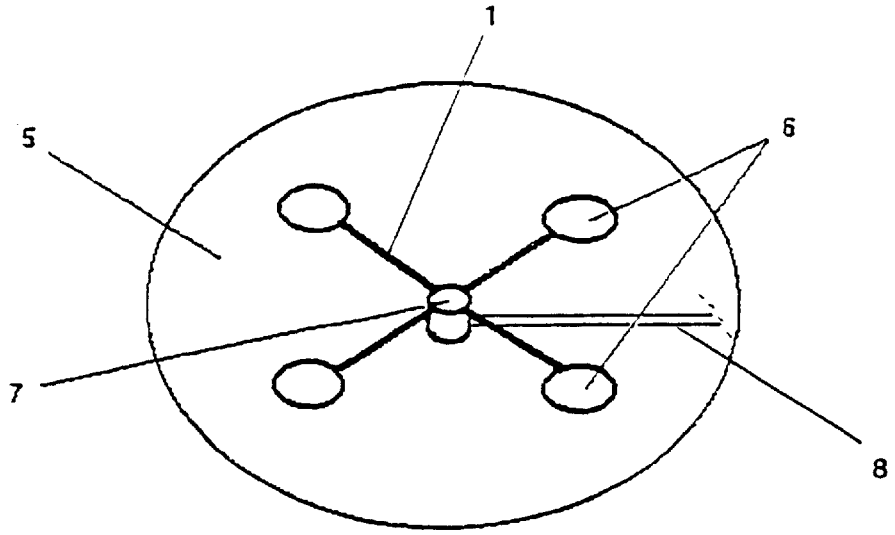
Figure 2:
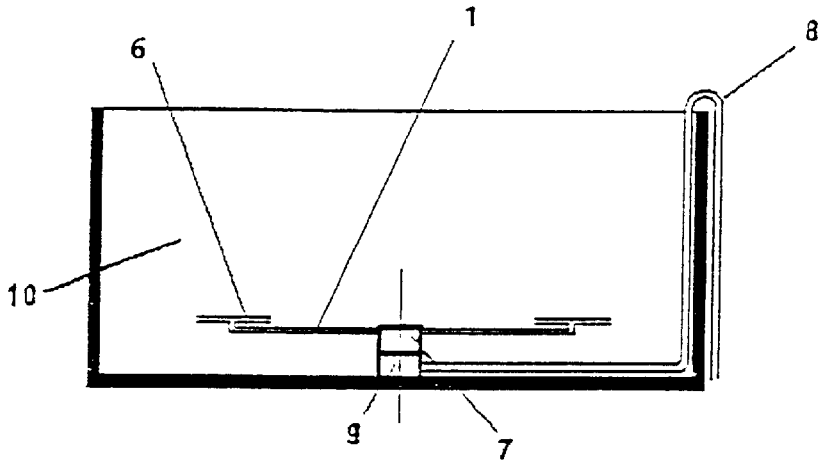
FIG. 2 shows a front view of the device of FIG. 1.

As we can see on FIGS. 1 and 2 with a first embodiment of the invention, the device is made of a container (10) of cylindrical shape, the bottom of which is horizontal.

A conduit (8) brings gas, for instance air, toward a distributor (9) placed in the center of the bottom of the container (10). A rotating injector (7) is placed over the distributor (9). Four hollow rods (12), bound to the injector (7) and horizontally disposed , radially extend from the injector (7), each rod (12) being perpendicular to the adjacent rod (12). Each rod (12) includes a nozzle (6) at the end which is opposed to the injector (7).

FIGS. 3 and 4 show a device identical to the one of FIGS. 1 and 2 with the exception that, additionally to a first system "injector (7)-rods (11)-nozzles (6)", it includes a second system "injector (7)-rods (12)-nozzles (6)". The second system is placed above the first system and the length of its rods (12) is greater to the one of the rods (11) of the first system.

Figure 5:
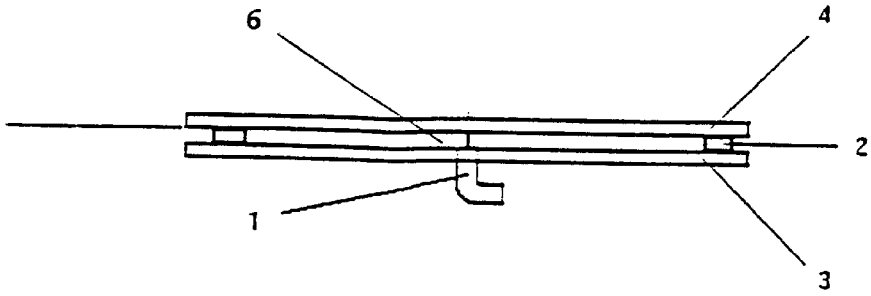
FIG. 5 shows a front view of a nozzle which can be used in the devices of FIGS. 1 to 4.
Figure 6:
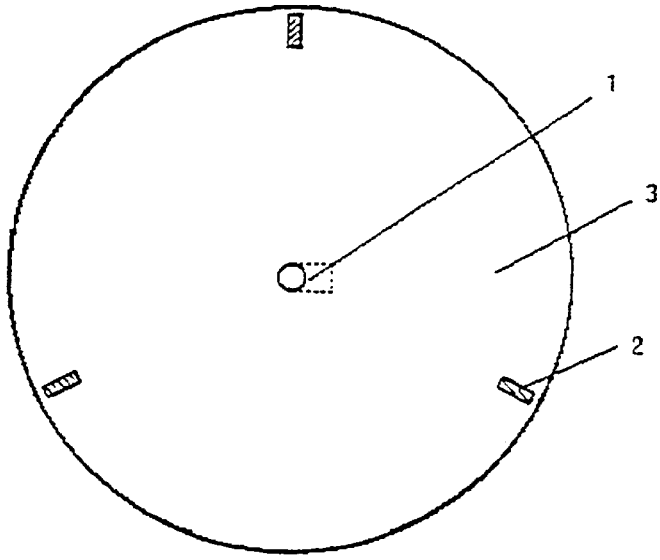
FIG. 6 shows an upper view of the nozzle of FIG. 5.

FIGS. 5 and 6 show a nozzle (6) which may be used in any of the previous described systems. It comprises two overlapping plates (3,4) of circular shape separated from each other with three spacers (2).

For each rod (11,12), one end (1) is being fixed toward the central part of the lower circular plate (3) and ends in the space between both plates (3,4).

Figure 7:
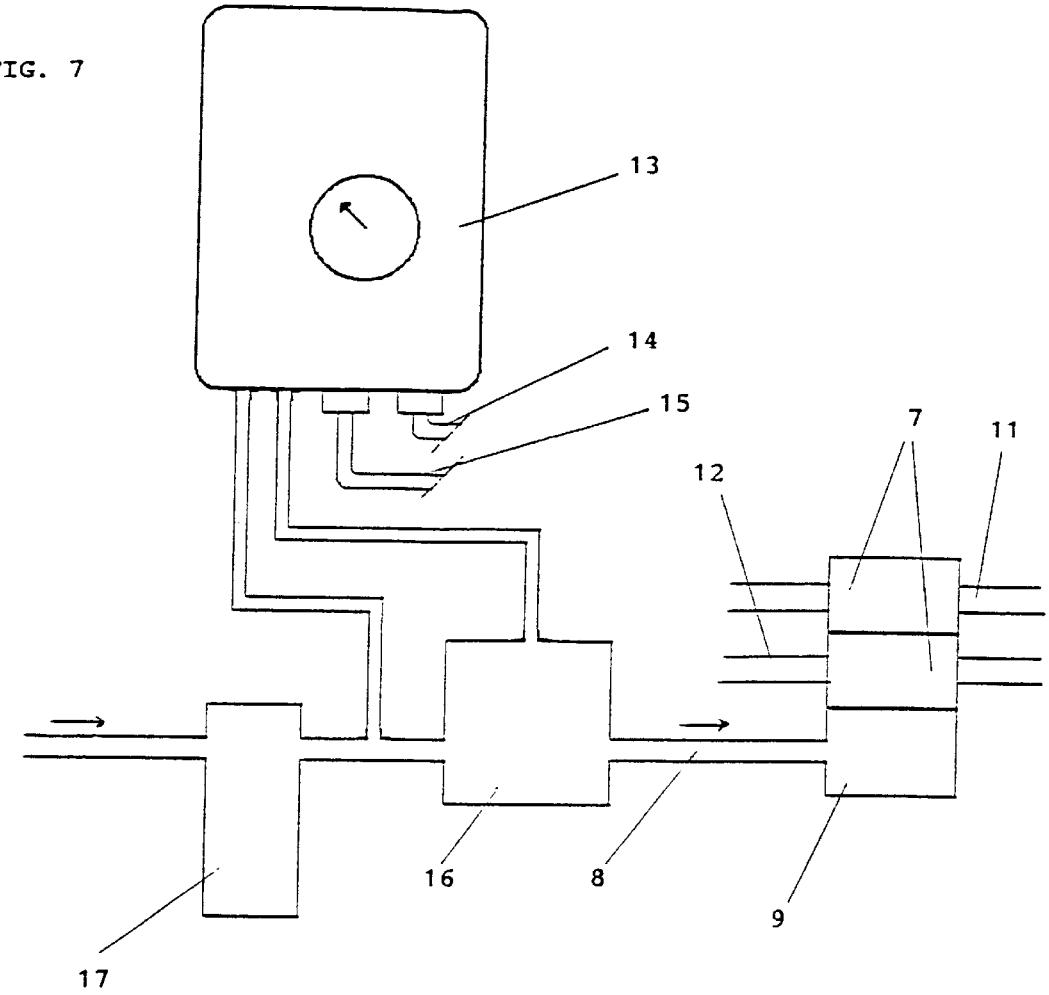
FIG. 7 shows a gas routing system for the devices of FIGS. 3 and 4.

FIG. 7 illustrates a gas routing system which is brought via the conduit (8) toward the nozzles (6).

Before accessing the distributor (9), the gas, which is shown with arrows, is moving across a filter (17) and a pneumatic valve (16), the regulating of the pneumatic valve (16) being controlled by a regulating assembly (13) which is remotely controlled (15) and which is supplied with an electrical cable (14).

The choice of the material components which form the container (10), the distributor (9), the injectors (7), the rods (11,12) and the nozzles (6) is not limited. According to the substances to be mixed, particularly resistant material will be preferred.

The functioning of the device will be explained from FIGS. 3 and 4. In a first step, the pneumatic valve (16) is regulated in such a way that the gas is brought toward the nozzles (6) and generates bubbles between both circular plates (3,4). Bubbles initiate the mixture when they elevate in the container which contains the fluid or solid substance (s).

After a predefined period, pneumatic valve (16) is activated in such a way that gas routing toward the nozzles (6) is stopped, leading to the interruption of bubble formation.

Using a non-illustrated valve and conduit system gas is brought in a system, made of e.g. blades situated within the rotating injectors (7) so that they can rotate with a predefined angle, e.g. 30°.

Once the predefined angle is obtained, pneumatic valve (16) is activated to allow the routing of the gas toward the nozzles (6), which results in a new mixing cycle as previously defined.

It should be noted that FIG. 7 is only a diagram. Conduit (8) which is comprised between pneumatic valve (16) and distributor (9) may be made of a plurality of conduits for which the opening is controlled by pneumatic valve (16), a part of said conduits being used to rotate the injectors (7), the other part being used for the routing of the gas toward the nozzles.

What is claimed is:

1. Device for moving fluid or solid substances with gas bubbles comprising:

a container adapted to contain said substances, at least one movable gas nozzle situated in a lower part of said container, the nozzle being fixed to a rotating vertical shaft via a rod, a nozzle driving means, a first gas routing system for the formation of bubbles at the nozzle, a second gas routing system for moving said nozzle, said second system being brought into relation with and partially being made of said nozzle driving means, momentary gas routing interrupting means adapted to allow gas routing either into the first system or into the second system.

2. Device according to claim 1 comprising a plurality of nozzles and corresponding rods adapted to rotate around said vertical shaft.

3. Device according to claim 1 comprising several series of nozzles, each series being defined by a specific rod length.

4. Device according to claim 1 wherein each nozzle comprises two overlapping plates which are maintained apart from each other with spacers, the first gas routing system ending approximately toward the center of the lower plate, in the space situated between both plates.

5. Method of using the device according to claim 1 characterized by a succession of cycles, each one comprising the following steps:

Injection of gas at the nozzle(s) via the first gas routing system,

Formation and emission of at least one bubble in the container,

Gas interruption in said first system,

Gas injection in the second gas routing system,

Rotation of the nozzle(s) with a predefined angle around the vertical shaft,

Gas interruption in said second system.

* * * * *